US005500636A

United States Patent [19]

Mitchell

[11] Patent Number: 5,500,636

[45] Date of Patent: Mar. 19, 1996

[54] TALKING LUGGAGE

[76] Inventor: John D. Mitchell, 2299 Donovan Dr., Eugene, Oreg. 97401

[21] Appl. No.: 498,569

[22] Filed: Jun. 20, 1995

[51] Int. Cl.[6] ..... G08B 3/00

[52] U.S. Cl. ..... 340/328; 190/102; 340/571; 340/692; 340/693; 369/69

[58] Field of Search ..... 340/571, 692, 340/693, 568, 328, 286.01; 360/137; 369/292, 69; 190/102; 346/25

[56] References Cited

U.S. PATENT DOCUMENTS

| | | | |
|---|---|---|---|
| 4,117,461 | 9/1978 | Kiebala | 340/545 |
| 4,117,468 | 9/1978 | Vasquez | 340/571 |
| 4,400,787 | 8/1983 | Mandel et al. | 395/2.79 |
| 4,728,937 | 3/1988 | Hsu | 340/571 |
| 4,804,943 | 2/1989 | Soleimani | 340/539 |
| 4,843,371 | 6/1989 | Kuei et al. | 340/539 |
| 4,884,507 | 12/1989 | Levy | 102/293 |
| 5,145,447 | 9/1992 | Goldfarb | 446/408 |
| 5,153,561 | 10/1992 | Johnson | 340/571 |
| 5,241,307 | 8/1993 | Bidault et al. | 340/944 |
| 5,291,183 | 3/1994 | Chiang | 340/692 |
| 5,463,369 | 10/1995 | Lamping | 340/692 |

*Primary Examiner*—Glen Swann
*Attorney, Agent, or Firm*—Richard C. Litman

[57] ABSTRACT

Luggage, having an audio recording and playing device within the luggage, housed in a pouch. The device is removable by the owner so that a message indicating where the owner is in his travels can be recorded on the recorder/player. An external plate includes indicia directing a luggage handler how to play the identifying message.

6 Claims, 5 Drawing Sheets

TALKING LUGGAGE

BACKGROUND OF THE INVENTION

1. FIELD OF THE INVENTION

The present invention relates to luggage equipped with a compact player/recorder; the luggage owner records an identifying message which can be played back by a luggage handler for the purpose of locating the luggage owner. Written instructions on the luggage tell the handler to push a button on the luggage to play the message.

2. DESCRIPTION OF THE PRIOR ART

Ever since the beginning of commercial transportation, business and leisure travelers alike are plagued with the fear that their luggage and other belongings will be lost or misshipped. Such belongings are entrusted to the care of sky caps, baggage handlers, bellmen and others who may fail to deliver the luggage and belongings in a timely fashion, or worse yet, direct the luggage and belongings to the wrong destination. While identifying baggage tags and other indicia help, often this data is out of date and/or only gives the owner's home address and telephone number. Such data is unlikely to assist in guiding the handler as to where to deliver the luggage and belongings during the owner's travels, viz., to a hotel or inn where the traveler will be staying. Clearly, then, the need exists for a more reliable means and method for better assuring the accurate and timely delivery of luggage and belongings to a traveler during his travels.

The instant invention provides the answer in the form of a small player/recorder whereby the user may record a message and then update the message periodically during his travels. Only the owner has access to the recorder/player to record and update his or her message. A baggage handler may simply push a single button on the outside of the luggage piece within which the invention is installed to listen to the prerecorded message of the owner. The message may, for example, give the owner's name, date and where the traveler is or may be staying. Simple printed instructions on the exterior surface of the piece of luggage instantly inform the handler what to do, e.g., push a button, and what this will tell him, e.g., owner and location of the owner of the piece of luggage.

Thus, the present invention, by providing a voice message to luggage handlers and others, will make it quite likely that the luggage is sure to be directed to its owner in a timely and accurate manner.

The prior art includes several examples of message recorders and players that deliver an audible message upon the occurrence of an event or events, but these are oblique to both the construction and function of the instant invention.

U.S. Pat. No. 4,117,461, issued on Sept. 26, 1978, to Carol L. Kiebala, discloses a tape recorder that plays a message encouraging dieting, when a door of a food storage compartment is opened and food or a food container is removed from a shelf. The instant invention is distinguishable, no only as to the environment of use, but also in that the message player is activated by pushing a button rather than opening a door, the message can be changed by the owner, and the message gives the name and current location of the owner.

U.S. Pat. No. 4,117,468, issued on Sept. 26, 1978, to Talio Vasquez, discloses a device that sounds an alarm to prevent a briefcase from being stolen. The instant invention is readily distinguishable in that it gives a verbal message, and can be activated by a legitimate luggage handler by simply pushing a button and then directing the luggage according to the message heard.

U.S. Pat. No. 4,400,787, issued on Aug. 23, 1983, to Alan F. Mandel and Kenneth M. Eichler, discloses an elevator system with a speech synthesizer for repetition of messages. The instant invention is distinguishable in that, besides being designed for luggage rather than elevators, the message is played in direct response to the listener pushing a button for that purpose.

U.S. Pat. No. 4,728,937, issued on Mar. 1, 1988, to Chi-Hsueh Hsu, discloses a security system for a suitcase, which gives a buzzing sound as a warning and then an electric shock to someone attempting to steal the suitcase. It does not give a verbal message which a legitimate luggage handler may access, and thus is quite unlike the instant invention.

U.S. Pat. No. 4,804,943, issued on Feb. 14, 1989, to Isaac Soleimani, discloses a remotely controlled briefcase alarm, which does not give a verbal message that may be played by a legitimate handler.

U.S. Pat. No. 4,843,371, issued on Jun. 27, 1989, to Liu C. Kuei, Chen C. Shui and Huang C. Lung, discloses a burglar-alarm system for a briefcase, which relies on electric shock, alarming sounds, flashes of light, and colored smokes, to prevent theft, but does not give a verbal message that may be played by a legitimate handler.

U.S. Pat. No. 4,884,507, issued on Dec. 5, 1989, to Isy R. Levy, discloses a security container or case for the storage of documents, credit cards, or other valuable materials, which will destroy such materials when someone attempts to steal the container. It does not play a message so that a legitimate handler may direct the luggage to its rightful owner.

U.S. Pat. No. 5,145,447, issued on Sept. 8, 1992, to Adolph E. Goldfarb, discloses a multiple choice verbal sound toy, which has a variety of keys to be depressed by a user, each of which cause a song or poem to be played. Unlike the instant invention, it does not allow new messages to be recorded by the owner and is not directed to the lost luggage problems of travelers.

U.S. Pat. No. 5,153,561, issued on Oct. 6, 1992, to Eric S. Johnson, discloses a secured valuable box for beach goers, which sounds an audible alarm, but does not play a message recorded by the owner and identifying the owner and just where he or she is staying or may be found.

U.S. Pat. No. 5,241,307, issued on Aug. 31, 1993, to Gerard Bidault and Dominique Leveque, discloses a sound signaling generation device for pedestrians, in which sound and optical signals are both activated by a single push button. It may be distinguished from the instant invention in that it is not designed to play a message recorded by an individual owner, especially in the context of lost luggage identification and retrieval.

None of the above inventions and patents, taken either singly or in combination, is seen to describe the instant invention as claimed.

SUMMARY OF THE INVENTION

The present invention provides the answer to lost luggage and its use allays the fear and concern of travelers that their luggage and other belongings will be lost. Also, common carriers and their insurers will save the costs associated with lost luggage claims, as any piece of luggage equipped with the present invention can be instantly identified and forwarded on to its owner wherever he may be during his travels. Furthermore, inefficiencies of operation associated with lost luggage in the travel industry as well as loss of goodwill and trust can be eliminated. The instant invention provides an uncomplicated little player/recorder that instantly transforms a piece of luggage to "talking luggage" that identifies the owner and his or her location by the mere pressing of a button. The player/recorder is installed into a pouch receiver within the luggage so that only the luggage owner has access to it to record and update an identifying, prerecorded message. During travel, should the luggage piece become lost or mishandled, all a handler has to do is press a button, as directed by indicia instructions readily seen on the outside of the piece of luggage, in order to hear an audible message which informs the handler of the owner's name and location at that point in the owner's journey. However, assuming the piece of luggage is locked, the handler does not have access to the inside of the luggage, and thus the identifying and locating message prerecorded by the owner remains intact until changed by the owner.

Accordingly, it is a principal object of the invention to provide a convenient means of identifying luggage by an audible message, prerecorded by the luggage owner.

It is another object of the invention to provide a means of identifying luggage that may be used by simply following printed instructions, pressing a button, and listening to a prerecorded, identifying message.

It is a further object of the invention to provide an audible luggage identifier, to help prevent luggage from being accidently lost or stolen.

Still another object of the invention is to provide a means of audibly identifying luggage, where the information provided can be easily updated.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Essentially, the invention is made up of a player/recorder having an irregular polyhedronal case configuration, a pouch container permanently installed within a piece of luggage, so that only the luggage owner has access to the player/recorder to record and update an identifying message, and indicia, perceivable from the exterior of the luggage, directing a luggage handler to simply press a button to hear a prerecorded message which identifies the owner of the luggage and his present or soon to be location during his journey.

Figure 1:
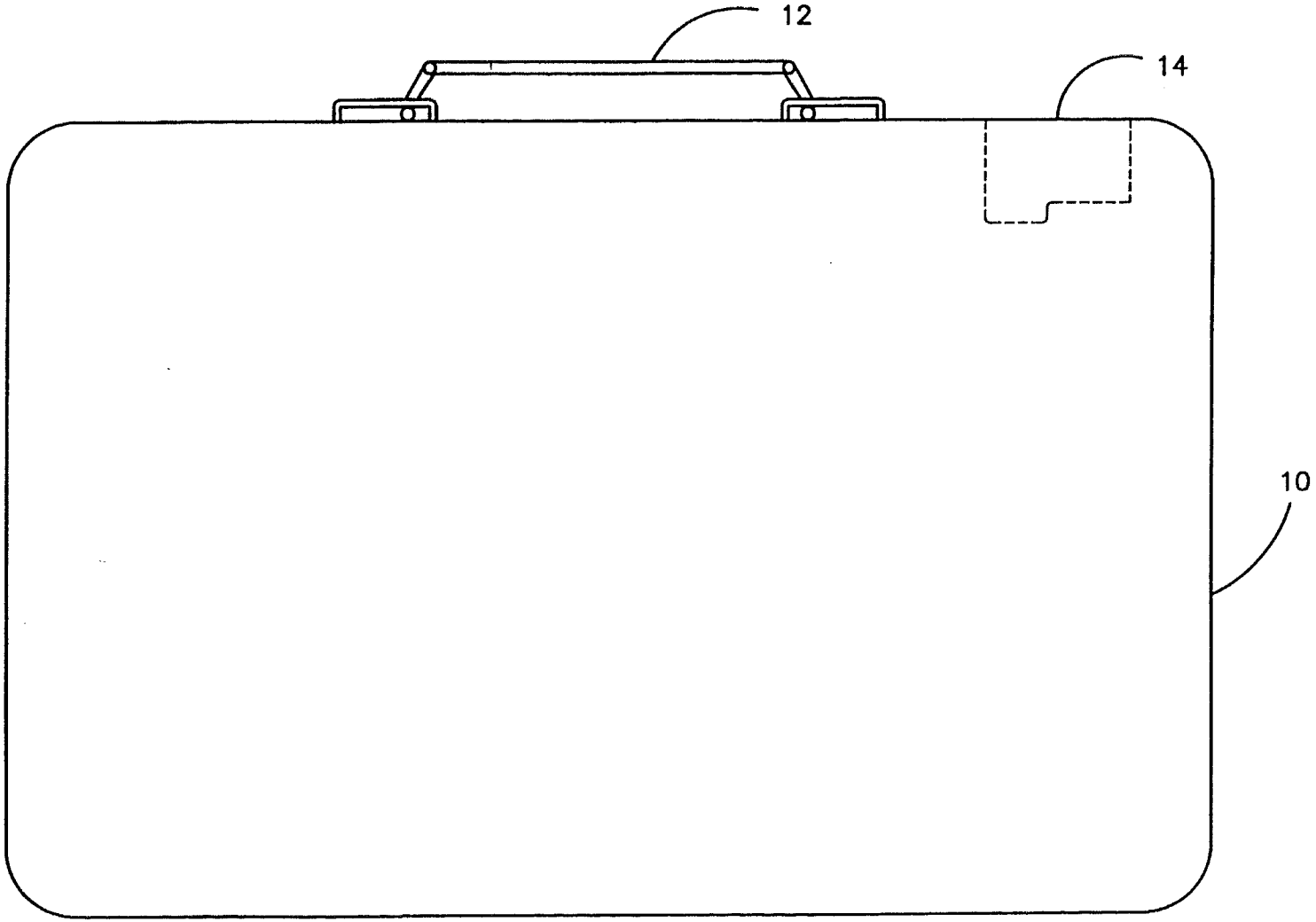
FIG. 1 is elevational front view of the invention installed within a piece of luggage.
Figure 2:
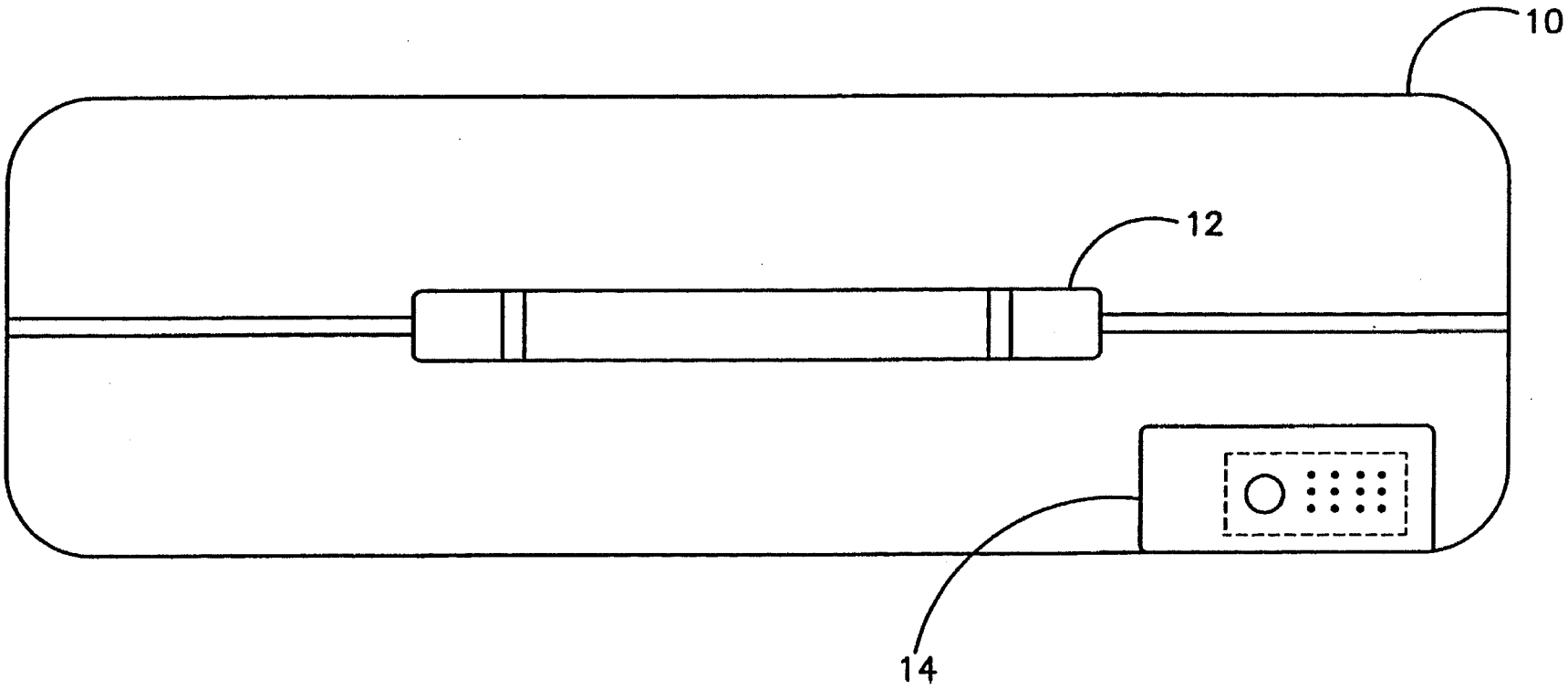
FIG. 2 is a top view of the invention as seen in FIG. 1.

FIG. 1 shows a piece of luggage in the form of a suitcase 10, having a handle 12, and the invention 14, including a message recorder and player, or player/recorder 14, installed within the luggage 10. FIG. 2 shows the same from the top of the luggage 10. The invention is innocuously sized and located, so as not to interfere with the regular utility of the luggage 10, yet is easily accessed from inside the luggage, in a manner and for a purpose to be explained hereinbelow, and can be operated from the exterior of the luggage by a luggage handler.

As employed in the context of the instant invention, the term "luggage" is meant to include, without limitation, a broad range of luggage pieces, such as hard sided and soft sided suitcases of any and all sizes, briefcases, ski and ski boot bags, bags, tennis racket cases, musical instrument cases, gun cases, carry-on luggage of any sort and description, overnight bags, sample cases, display cases, golf club bags, lunch bags, and most any other sort of container with or without a handle.

As can be appreciated from an inspection of FIG. 3, the player/recorder 15 of the invention 14 is housed within a pouch container 32, which is permanently installed within the luggage 10 as will be explained below. The player/recorder 15 is battery powered, and includes a pair of replaceable batteries 26, 26, for example. A record button is located at 16 and an activator, message play button is located at 17, beneath an externally accessible activator 18, positioned directly atop the button 17. The player/recorder is of irregular, polyhedronal configuration so that it fits into pouch container 32 in only one disposition, thus to assure that button 17 is always directly beneath activator 18. As can be further appreciated from FIG. 3, the left side 20 of the pouch 32 includes an access door 22, hinged at 24 to be opened, so that the player/recorder 15 may be removed to record a message, and thereafter reinserted into pouch 32 and secured therein. The construction of hinge 24 may be a simple pin hinge, or piano hinge, or a living hinge, particularly when the pouch 32 is cast or molded as an integral unit of suitable plastics material or the like. The door may have a latch construction to keep the door closed, as by provision of a pair of tabs 40, 40 received in friction fit fashion in a pair of slots 42, 42, seen in FIG. 6, formed in a door latch plate 44, formed as an extension of the pouch container 32.

Figure 3:
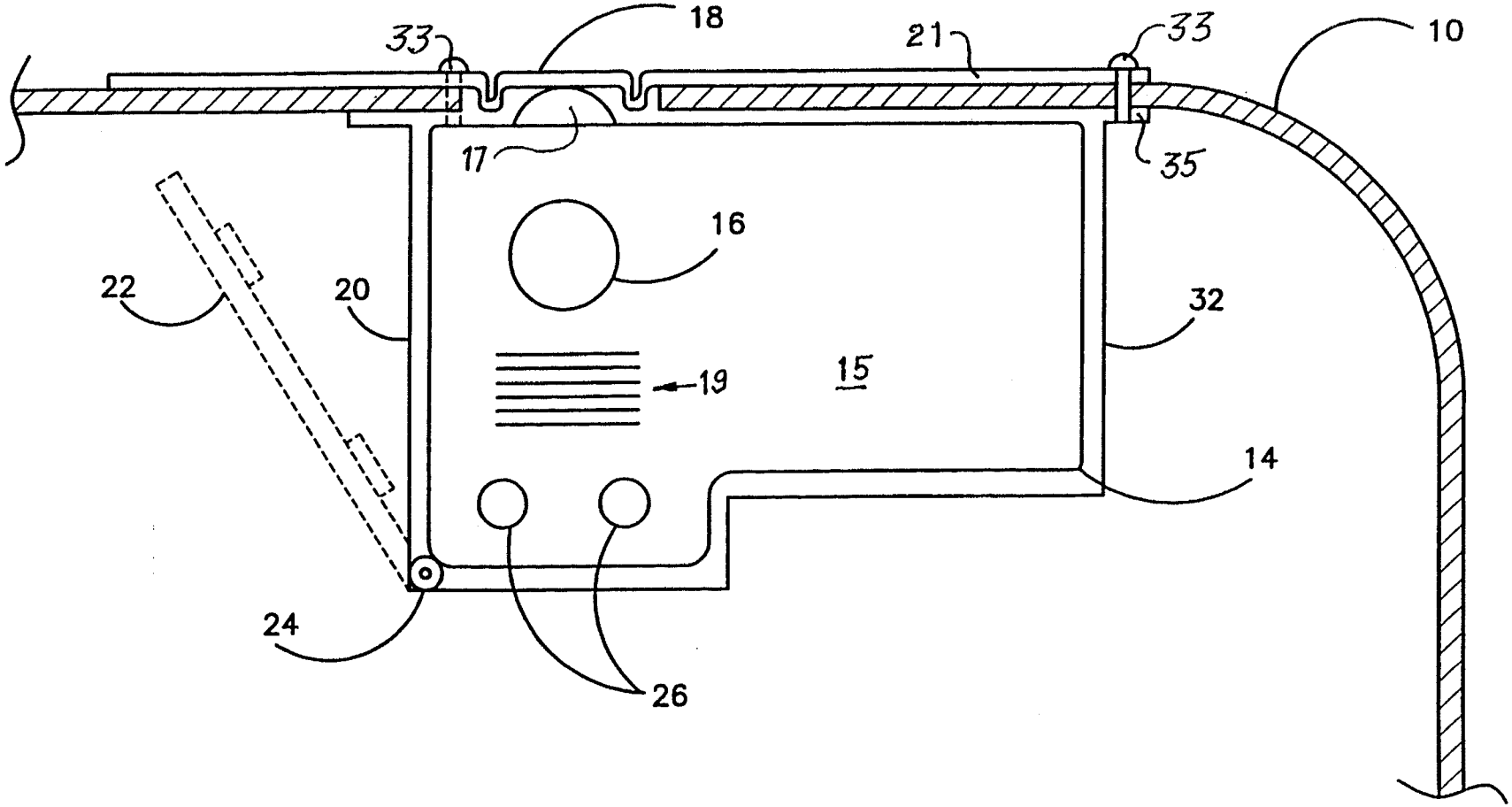
FIG. 3 is an enlarged scale, elevational front view of a portion of the invention.
Figure 4:
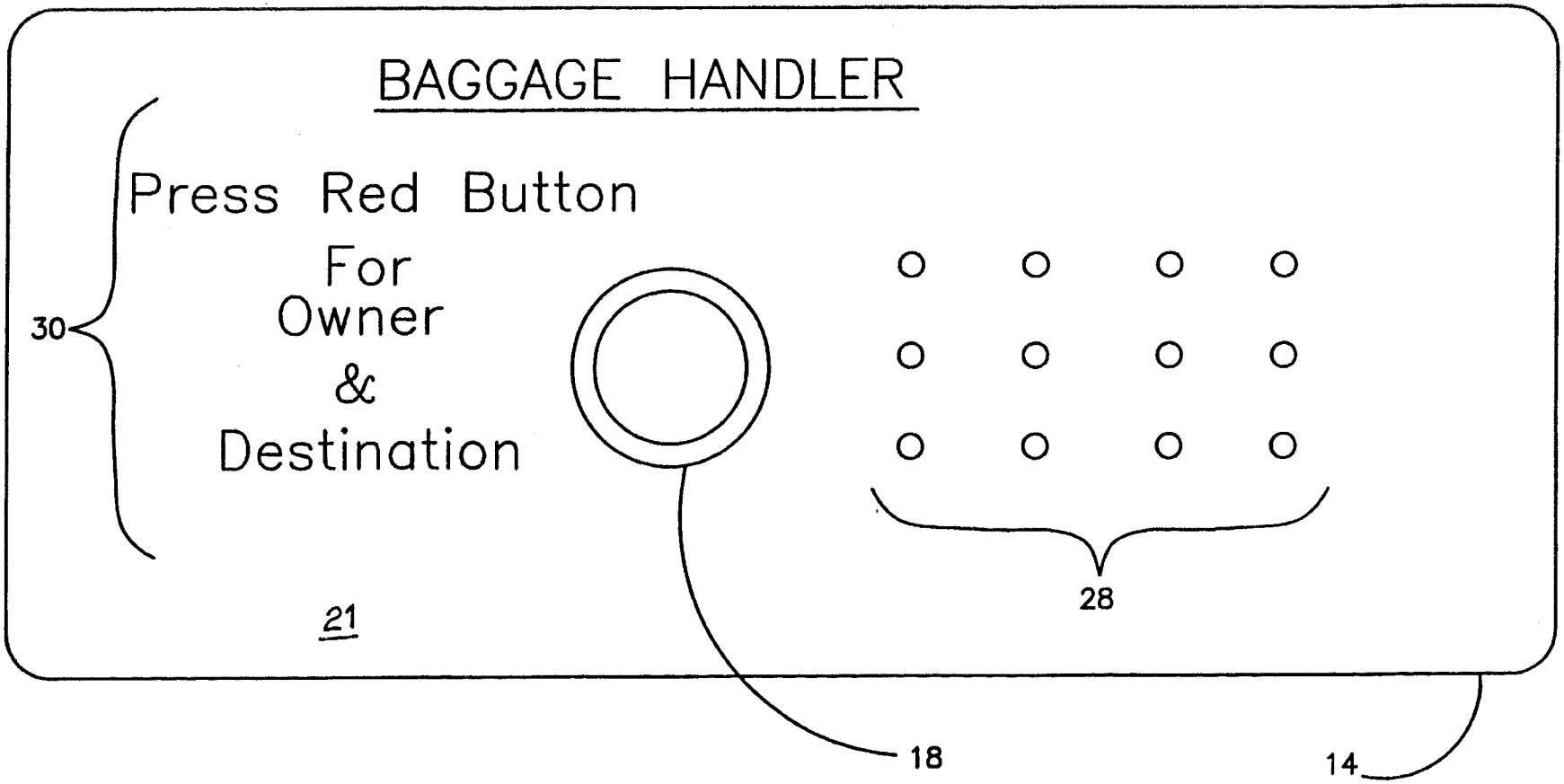
FIG. 4 is an enlarged scale, top view of the printed instructions portion of the invention.

Referring now to FIGS. 3 and 4, the invention includes an exterior mounting and message plate 21 which provides readily perceived, printed instructions for the baggage handler. Once the message is recorded by the user and the recorder 15 installed and latched into pouch 15, the invention is ready for use. Thus, a baggage handler need only depress the activator 18 to hear a message, such as: "I belong to Mr. Jones, staying at the Hyatt Regency Hotel, Chicago O'Hare Airport, Feb. 14 to 18. Please expedite me to that location." Should the baggage handler not remember all the information recorded, he need only press the activator 18 again, since the player/recorder 15 includes a standard reset, wherein once the message is heard, the device automatically rewinds so that the message may be heard again.

It is noted here that the internal electronics of the recorder/player 15 form no part of the instant invention per se. Such devices are readily known and available. As for the instant invention, only the external configuration of the case of the device 15 is novel, so that it fits in pouch 32 in only one manner, thus to assure that the button 17 is beneath the activator 18.

Figure 6:
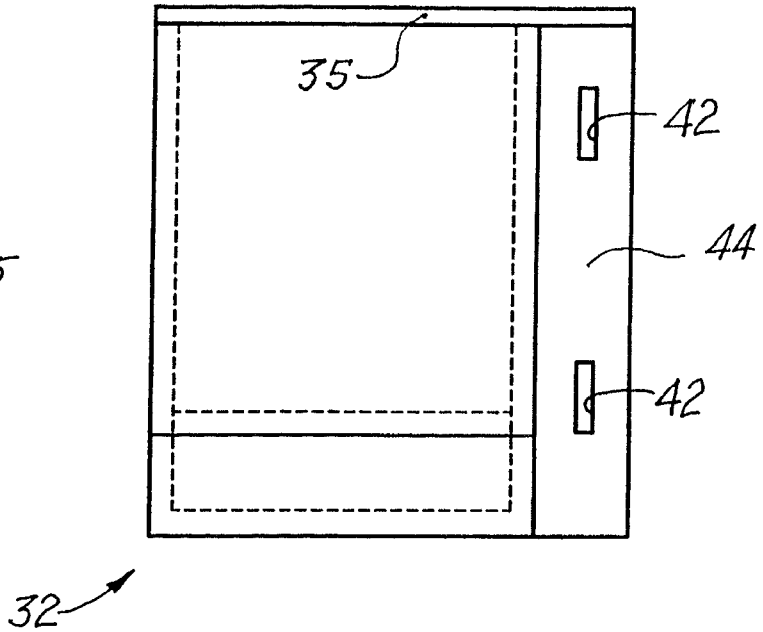
FIG. 6 is an elevational end view of the pouch of the invention as seen in FIG. 5.
Figure 5:
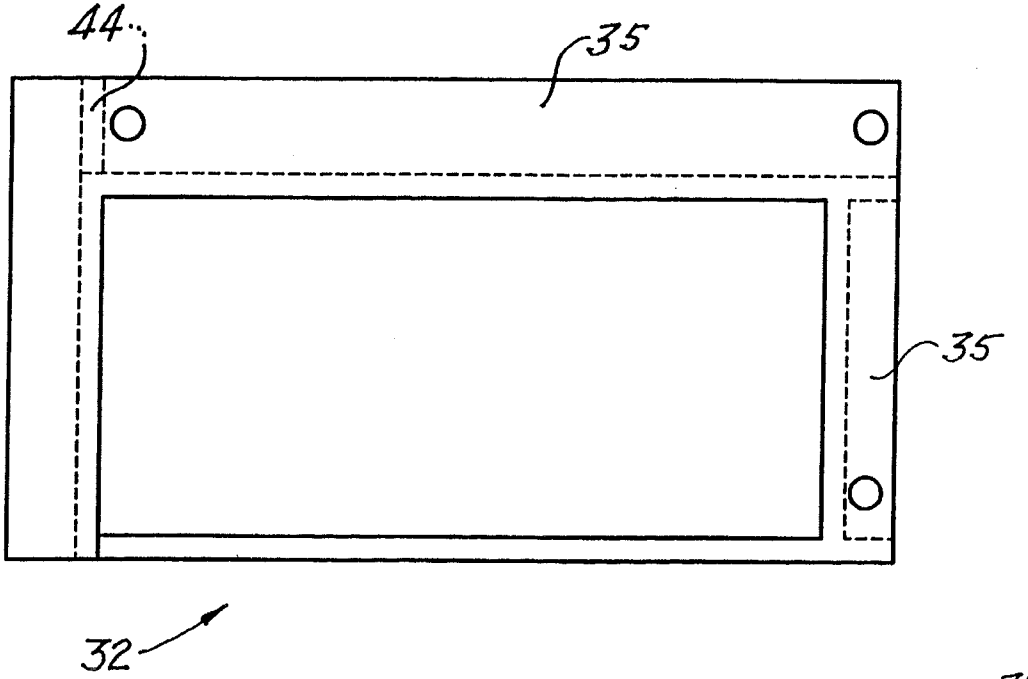
FIG. 5 is an enlarged scale, top view of the pouch container for housing the player/recorder of the invention.

The mounting and message plate 21 is attached permanently to both the luggage 10 and the recorder/player pouch container 32 by any suitable means, such as a number of rivets 33, secured through the plate 21, a wall of the luggage 10, and into and through a mounting flange 35, formed at the top of the pouch 32, as best seen in FIGS. 5 and 6. The plate 21 may be made of a clear plastic material with the instruction message 30 engraved into the bottom or underside thereof, so that it will not be worn off, even by repeated usage of the luggage. Alternatively, the plate may be translucent, or opaque; in the latter instance, of course, the instruction message 30 would be engraved into or printed upon the top surface of the plate 21.

As will be appreciated from FIGS. 2, 3 and 4, message sound from the player/recorder minispeaker 19 may be heard externally by providing a plurality of openings 28 through the plate 21. Alternatively, of course, the speaker 19 could be located immediately beneath the openings 28 (not shown).

By now, it will be fully realized that the baggage handler need only follow instructions and depress button activator 18 in order to hear a prerecorded message as to where to direct the piece of luggage at hand. It will be noted here that, assuming the piece of luggage 10 is closed/locked, the handler will have no access to the player/recorder 15, where he or she could inadvertently or deliberately change or erase the message prerecorded by the luggage owner. Also, the traveller, after completion of a leg of his or her trip, may simply open door 22, remove the player/recorder 15 and record a new message, and then reinstall the player/recorder.

It is to be understood that the present invention is not limited to the sole embodiment described above, but encompasses any and all embodiments within the scope of the following claims.

I claim:

1. For use with luggage, an audible luggage identifier comprising:

a player/recorder having record, playback and reset features;

a player/recorder pouch container, permanently installed within luggage, for receiving said player/recorder;

means permitting temporary securement of said player/recorder within said pouch; and player/recorder message playback activation means accessible externally of said luggage, for playing an audible message prerecorded on said player/recorder.

2. The audible luggage identifier according to claim 1, said pouch having an irregular, internal, polyhedronal configuration, said player/recorder having a mating, external, irregular polyhedronal configuration, whereby said player/recorder may be disposed within said pouch in only one disposition.

3. The audible luggage identifier according to claim 1, further comprising indicia means, perceivable from externally of the luggage, for directing a user in the manner of playing a message prerecorded on said player/recorder.

4. The audible luggage identifier according to claim 1, wherein said means permitting temporary securement of said player/recorder within said pouch comprise a door hingedly attached to an open end formed in said pouch, there further being latch means for retaining said door closed with said player/recorder disposed within said pouch.

5. The audible luggage identifier according to claim 1, wherein said pouch is made integrally of plastics material.

6. The audible luggage identifier according to claim 1, wherein said player/recorder message playback activation means accessible externally of said luggage comprise an activator strategically dimensioned and located so as to actuate said recorder/player to play a message, when said activator is depressed.

* * * * *

UNITED STATES PATENT AND TRADEMARK OFFICE

CERTIFICATE OF CORRECTION

PATENT NO. : 5,500,636

DATED : March 19, 1996

INVENTOR(S) : John D. Mitchell

It is certified that error appears in the above-indentified patent and that said Letters Patent is hereby corrected as shown below:

On the title page, item [22], change June 20, 1995" to --July 6, 1995--.

Signed and Sealed this

Eleventh Day of June, 1996

*Attest:*

*Attesting Officer*

BRUCE LEHMAN

*Commissioner of Patents and Trademarks*